US008857387B2

(12) United States Patent
Schlidt et al.

(10) Patent No.: US 8,857,387 B2
(45) Date of Patent: Oct. 14, 2014

(54) CYLINDER HEAD WITH LIQUID COOLING SYSTEM AND METHOD FOR COOLING THE CYLINDER HEAD

(75) Inventors: Waldemar Schlidt, Ruesselsheim (DE); Peter Seeger, Bensheim (DE); Stefan Vogel, Mainz (DE); Carsten Tauscher, Trebur (DE); Markus Klein, Darmstadt (DE); Roland Maucher, Eltville (DE); Jan Zimmermann, Mainz (DE)

(73) Assignee: GM Global Technology Operations LLC, Detroit, MI (US)

( * ) Notice: Subject to any disclaimer, the term of this patent is extended or adjusted under 35 U.S.C. 154(b) by 505 days.

(21) Appl. No.: 13/302,042

(22) Filed: Nov. 22, 2011

(65) Prior Publication Data

US 2012/0132156 A1 May 31, 2012

(30) Foreign Application Priority Data

Nov. 29, 2010 (DE) ..... 10 2010 052 830

(51) Int. Cl.
*F02F 1/14* (2006.01)
*F02F 1/36* (2006.01)

(52) U.S. Cl.
USPC ..... 123/41.82 R; 123/41.79

(58) Field of Classification Search
USPC ..... 123/41.74, 41.79, 41.82 R, 193.5
See application file for complete search history.

(56) References Cited

U.S. PATENT DOCUMENTS

| | | | |
|---|---|---|---|
| 5,799,627 | A | 9/1998 | Dohn et al. |
| 6,827,049 | B2 | 12/2004 | Oh |
| 6,976,683 | B2 | 12/2005 | Eckert et al. |
| 2006/0196453 | A1 | 9/2006 | Yamada et al. |

FOREIGN PATENT DOCUMENTS

| | | | |
|---|---|---|---|
| DE | 19542494 | C1 | 1/1987 |
| DE | 102005057760 | A1 | 7/2006 |
| EP | 1510681 | A1 | 3/2005 |
| GB | 2420845 | A | 6/2006 |
| JP | 2006242030 | A | 9/2006 |

*Primary Examiner* — Noah Kamen

(74) *Attorney, Agent, or Firm* — Ingrassia Fisher & Lorenz, P.C.

(57) ABSTRACT

A cylinder head is provided with liquid cooling system and a method for cooling the cylinder head. The cylinder head includes, but is not limited to a liquid jacket in which a coolant flows along a main flow pathway from a coolant inlet to a coolant outlet. The liquid jacket is interrupted between the coolant inlet and coolant outlet by portals to cylinders of an internal combustion engine. A second portal is arranged in a flow shadow of a first portal. The cylinder head in the liquid jacket exhibits a flow guide wall with a constriction of the flow cross section, and a baffle plate, which is arranged in the direction of the main flow pathway, downstream from the flow guide wall. The baffle plate is designed to divert a coolant flow branch in a direction of flow transverse to the main flow pathway, toward the second portal.

16 Claims, 2 Drawing Sheets

CYLINDER HEAD WITH LIQUID COOLING SYSTEM AND METHOD FOR COOLING THE CYLINDER HEAD

CROSS-REFERENCE TO RELATED APPLICATION

This application claims priority to German Patent Application No. 102010052830.7, filed Nov. 29, 2010, which is incorporated herein by reference in its entirety.

TECHNICAL FIELD

The technical field relates to a cylinder head with liquid cooling system and a method for cooling the cylinder head. The cylinder head exhibits a liquid jacket in which a coolant flows along a main flow pathway from a coolant inlet to a coolant outlet. The liquid jacket is interrupted between the coolant inlet and coolant outlet by portals to cylinders of an internal combustion engine. A second portal is arranged in a flow shadow of a first portal.

BACKGROUND

A second portal cannot be cooled as intensively by the flow shadow as a first portal. It is here that if the first portal to a cylinder is furnished with an injection nozzle that is completely cooled by a liquid jacket. By contrast, the second portal is provided with an ignition device, which is arranged parallel to the camshaft, and now exposed to an elevated temperature load in the flow shadow of the injection nozzle. An excess temperature of the ignition plug can lead to pre-inflammation and knocking in the combustion engine. This is unfavorable especially in charged engines, since the combustion chamber pressure and combustion chamber temperature are obviously correlated with the maximum torque.

High temperatures on the ignition plug increase the probability of a mechanical failure. In addition, the injection nozzle or injector is exposed to the extremely high temperatures of the combustion chamber in directly and centrally injecting internal combustion engines with a longitudinally perfused liquid cooling system. When the injector is in a central position, the temperature at the injector tip rises by up to approximately 15° C. compared with a lateral injector arrangement. This also increases the danger of harmful fuel deposits forming on the injection nozzle.

Known from publication U.S. Pat. No. 6,827,049 B2 is a water jacket with exhaust manifold outlet openings, which remove the exhaust gases of a cylinder. The water jacket exhibits an upper, central, and lower water pathway. The lower water pathway of the water jacket exhibits sealed off areas that force the coolant to flow through the central water pathway. As a result, this publication discloses that a coolant can be forced to cool thermally critical areas more intensively by taking suitable measures and shaping the water jacket.

At least one object is to create a cylinder head with a liquid cooling system in which cooling is improved in thermally critical areas. In addition, other objects, desirable features, and characteristics will become apparent from the subsequent summary and detailed description, and the appended claims, taken in conjunction with the accompanying drawings and this background.

SUMMARY

In one embodiment of the cylinder head with liquid cooling system, the latter exhibits a liquid jacket, in which a coolant flows along a main flow pathway from a coolant inlet to a coolant outlet. The liquid jacket is interrupted between the coolant inlet and coolant outlet by portals to cylinders of an internal combustion engine. A second portal is arranged in the flow shadow of a first portal. The cylinder head exhibits a flow guide wall with a constricting flow cross section, and a baffle plate in the liquid jacket, which is situated downstream from the flow guide wall in the direction of the main flow pathway. The baffle plate is designed to branch off a portion of the coolant in a direction of flow transverse to the main flow pathway, toward the second portal.

This structural design of the coolant jacket advantageously compensates for the diminished cooling of the second portal owing to its location in the coolant stream, specifically in the flow shadow of the first portal, and ensures that the second portal is sufficiently cooled, while preventing an excessive temperature rise, so that no pre-inflammation or knocking take place in the engine. In practical application, the pulse of a branched flow is targeted at the then installed ignition plug, and the heat transfer is tangibly increased in the ignition plug region.

The additionally possible introduction of flow guide walls to a nozzle-like, continuously tapering constriction in conjunction with the expansion of the flow cross section after the constriction makes it possible to significantly accelerate the coolant flow, turning it into a coolant jet that then hits a wall, which acts as a baffle plate, and is designed in such a way as to divert a branch of the streaming coolant transverse to the direction of the main flow pathway, and in part also exhibits a component opposite the main direction of flow, so that the diminished cooling effect can be reversed almost completely by arranging a first and second portal one after the other, and achieving the flow shadowing associated therewith. At least in experiments, it was possible to achieve a clear temperature drop of approximately 15° C. by comparison to a liquid jacket not structured in this way in the area of the second portal.

In other embodiments, the first portal can here comprise an injection nozzle portal to one of the cylinders, and/or the second portal can form an ignition portal to one of the cylinders. Due to the shape of the liquid jacket described previously, the ignition plug located in the ignition portal could now be sufficiently cooled, and no longer exhibits any more malfunctions in the experiments mentioned above.

In order to achieve the acceleration effect of the coolant in the branched coolant stream that is diverted to a cross stream in the main flow pathway, the flow guide wall can in another embodiment also be designed as a separating wall, which is located between the liquid jacket and the second portal, and aligned in the direction of flow of the main flow pathway. For example, the constriction of the cross section can be narrowed by at least twofold in this region, and then expands again after the flow guide wall toward the baffle plate. In addition, another embodiment can also provide that each cylinder in the internal combustion engine exhibits a third portal in the cylinder head for an inlet valve, and a fourth portal for an outlet valve.

The four portals for the inlet valve, outlet valve, and ignition plug and injection nozzle per cylinder are arranged in two rows one in back of the other. The main flow pathway is divided into three coolant flow branches with nearly an identical cross section, specifically into a central coolant flow pathway between the two rows, and two external coolant flow pathways between the outer walls of the liquid jacket and bordering walls of the portals. One of the outer coolant flow pathways is used to cool the downstream second portal more intensively than before. Such a cylinder head is preferably used for internal combustion engines in vehicles.

A method for cooling a cylinder head of an internal combustion engine exhibits the following procedural steps. A coolant is first supplied to a coolant inlet of the cylinder head. A main flow pathway from a coolant inlet to a coolant outlet forms in the process. This main flow pathway is divided into several coolant flow branches by ports through the cylinder head to cylinders of the internal combustion engine. The flow cross section of one of the coolant flow branches constricts at a second portal through a flow guide wall arranged downstream in the flow shadow of a first portal. This is followed by an expansion of the flow cross section in the direction of flow after the flow guide wall and by a diversion of the streaming coolant of the coolant flow branch transverse to the main flow pathway on a baffle plate, with the stream moving toward the second portal. The advantage to this method is that the second portal is now exposed to a sufficient flow and cooling.

The flow rate of the coolant flow branch in the region of the flow guide wall is increased by the constriction of the flow cross section, so that a coolant jet hits the baffle plate from the end of the flow guide wall at an elevated flow rate. A partially backwardly directed coolant flow component of the coolant flow branch diverted at the baffle plate cools the second portal lying downstream from the first portal more intensively.

This interaction between the flow guide wall, constriction of the cross section, expansion of the cross section, and diversion of the arising jet against a baffle wall or baffle plate can also be regarded as a blade effect of the kind encountered in turbine blades. The pulse of the global stream or main flow pathway is in this case directed at the ignition plug, and the heat transfer in the ignition plug region is tangibly increased. The suitable flow distribution in the cylinder head liquid jacket is brought about via the targeted shaping of the coolant jacket in conjunction with the configuration of corresponding sealing transitions.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
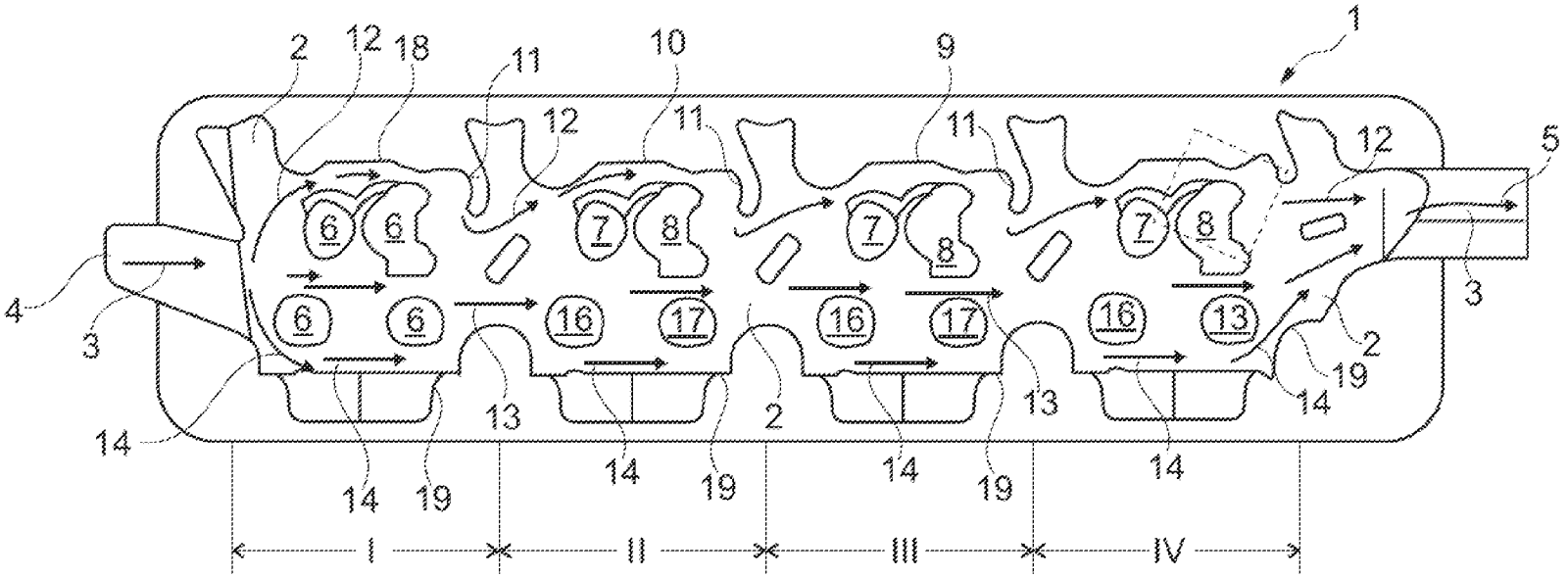
FIG. 1 shows a diagrammatic view of a coolant jacket of a cylinder head in a combustion engine with four cylinders.

FIG. 1 shows a diagrammatic view of a coolant jacket 2 of a cylinder head 1 in a combustion engine with four cylinder regions I, II, III and IV. A respective four portals 6 are provided for the four cylinder regions in the coolant jacket 2, wherein a first portal 7 accommodates an injection nozzle, and a second portal 8 situated in back of the first portal 7 in the direction of flow exhibits an ignition plug arrangement, wherein portals 7 and 8 of the four cylinder regions I to IV have a third portal 16 with an inlet valve to each cylinder, and a fourth portal 17 with an outlet valve from every cylinder. The coolant jacket 2 is bordered by the outer walls 18 and 19.

The third and fourth portals 16 and 17 are also arranged one behind the other, and yield a second row in the coolant jacket 2. The coolant jacket 2 exhibits a coolant inlet 4 and coolant outlet 5. A main flow pathway 3 flows from the coolant inlet 4 to the coolant outlet 5, and is divided into three coolant flow branches by the two rows of portals. One central coolant flow branch 13, an outer coolant flow branch 12 that steams by the first and second portals 7 and 8, as well as another outer coolant flow branch 14 that streams by the third portal 16 and fourth portal 17.

Figure 2:
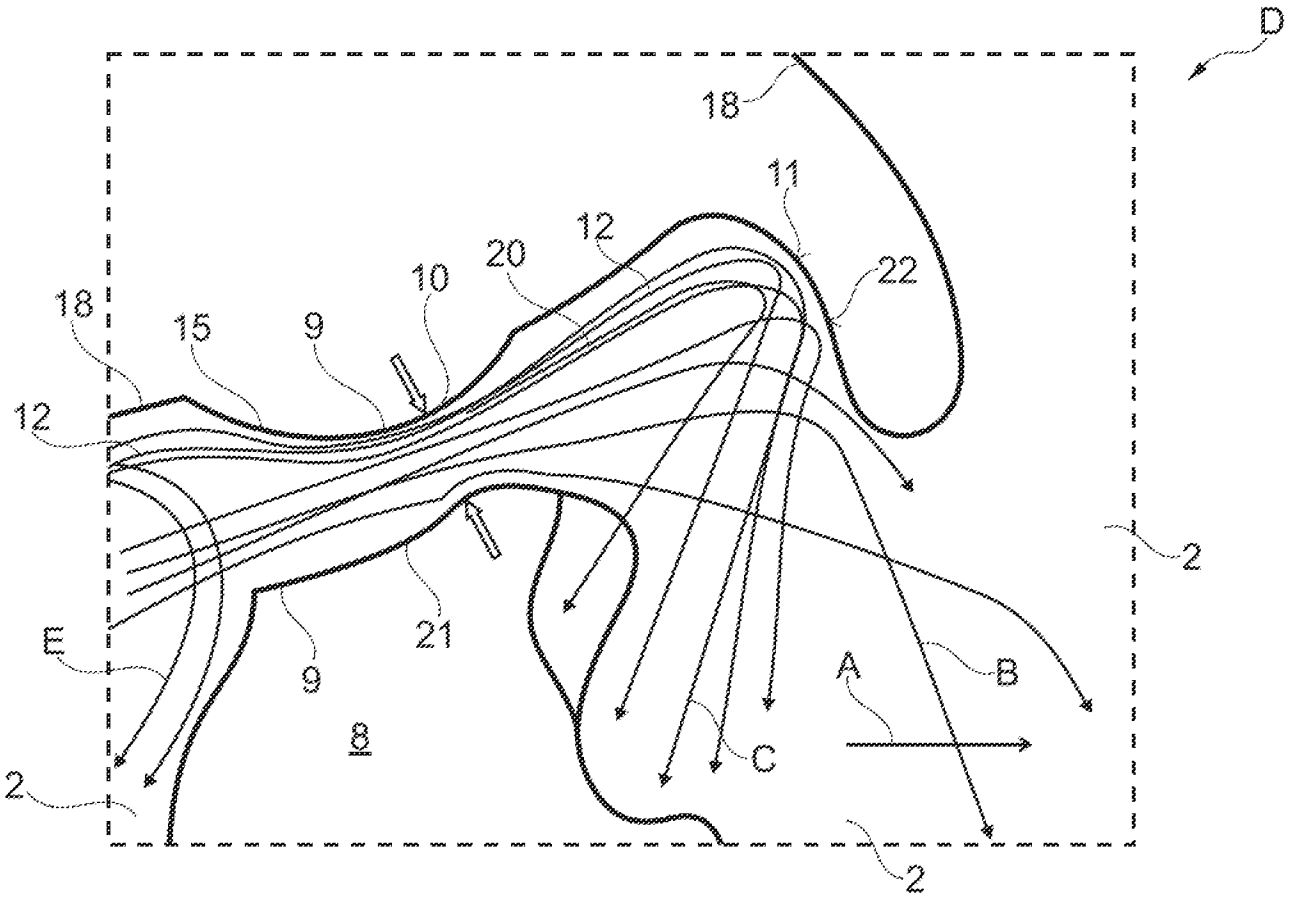
FIG. 2 shows a magnified section of the coolant jacket according to FIG. 1 in the area of a portal to a cylinder, which incorporates an ignition plug.

FIG. 2 shows a magnified section D of the coolant jacket 2 according to FIG. 1 in the region of the second portal 8 to a cylinder. An ignition plug is arranged in the portal 8. This section D exhibits the outer coolant flow branch 12, which is bordered by an outer wall 18 of the coolant jacket 2, and by the walls in this case of the portal 8. In the section D shown here, the outer wall 18 of the coolant jacket 2 in the region of a lateral face 15 and a bordering wall 21 of the portal 8 are designed as flow guide walls 9, which taper the cross section for the outer coolant flow branch 12 to form a constriction 10. The sudden expansion of the cross section that follows the constriction 10 produces a nozzle effect, so that the coolant exits the constriction 10 at an elevated rate, hitting a wall section 22 arranged opposite the constriction 10 acting as a nozzle in the form of a coolant jet 20.

This wall section 22 acts as a baffle plate 11, and deflects the coolant flow branch 12, so that components of the coolant flow branch 12 stream in part transverse to the main flow pathway A in direction of arrow B, and in part opposite the main flow pathway A with a flow component in direction of arrow C, thereby cooling the portal 8 accommodating the ignition plug more intensively. A portion of the outer coolant flow branch 12 is already deflected in direction of arrow E before the constriction 10, so that this portion of coolant streams through the region of the coolant jacket 2 between the first portal and second portal 8, since this portion of the flow in direction of arrow E also streams transverse to the main flow pathway in direction of arrow A.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A cylinder head with a liquid cooling system, comprising:

a coolant inlet;

a coolant outlet;

a main flow pathway configured to provide a path for a coolant flow from the coolant inlet to the coolant outlet;

a liquid jacket interrupted between the coolant inlet and the coolant outlet by a plurality of portals to a plurality of cylinders of an internal combustion engine;

a second portal arranged in a flow shadow of a first portal; and a flow guide wall with a constriction of a flow cross section; and a baffle plate arranged in a direction of the main flow pathway downstream from the flow guide wall, the baffle plate is configured to divert a coolant flow branch in a direction of flow transverse to the main flow pathway toward the second portal.

2. The cylinder head according to claim 1, wherein the first portal is configured to form an injection nozzle portal to one of the plurality of cylinders.

3. The cylinder head according to claim 1, wherein the second portal is configured to form an ignition portal to one of the plurality of cylinders.

4. The cylinder head according to claim 1, wherein the flow guide wall is a separating wall between the liquid jacket and the second portal aligned in the direction of flow of the main flow pathway.

5. The cylinder head according to claim 1, wherein the flow cross section expands toward the baffle plate after the flow guide wall.

6. The cylinder head according to claim 1, wherein the cylinder head comprises an injection nozzle arrangement in the first portal.

7. The cylinder head according to claim 1, wherein the cylinder head in the second portal comprises an ignition plug arrangement.

8. An internal combustion engine, comprising:

a liquid cooling system; and a cylinder head with the liquid cooling system, the cylinder head comprising:

a coolant inlet;

a coolant outlet;

a main flow pathway configured to provide a path for a coolant flow from the coolant inlet to the coolant outlet;

a liquid jacket interrupted between the coolant inlet and the coolant outlet by a plurality of portals to a plurality of cylinders of the internal combustion engine;

a second portal arranged in a flow shadow of a first portal; and a flow guide wall with a constriction of a flow cross section; and a baffle plate arranged in a direction of the main flow pathway downstream from the flow guide wall, the baffle plate is configured to divert a coolant flow branch in a direction of flow transverse to the main flow pathway toward the second portal.

9. The internal combustion engine according to claim 8, wherein each cylinder of the internal combustion engine comprises:

a third portal in the cylinder head for an inlet valve; and a fourth portal for an outlet valve.

10. The internal combustion engine according to claim 9, wherein the first portal, the second portal, the third portal, and the fourth portal are arranged in two rows, and wherein the main flow pathway is divided into three coolant flow branches with a substantially similar cross section.

11. The internal combustion engine according to claim 8, wherein the first portal is configured to form an injection nozzle portal to one of the plurality of cylinders.

12. The internal combustion engine according to claim 8, wherein the second portal is configured to form an ignition portal to one of the plurality of cylinders.

13. The internal combustion engine according to claim 8, wherein the flow guide wall is a separating wall between the liquid jacket and the second portal aligned in the direction of flow of the main flow pathway.

14. The internal combustion engine according to claim 8, wherein the flow cross section expands toward the baffle plate after the flow guide wall.

15. The internal combustion engine according to claim 8, wherein the cylinder head comprises an injection nozzle arrangement in the first portal.

16. The internal combustion engine according to claim 8, wherein the cylinder head in the second portal comprises an ignition plug arrangement.

* * * * *